US006402345B1

(12) United States Patent
Fishman

(10) Patent No.: US 6,402,345 B1
(45) Date of Patent: Jun. 11, 2002

(54) LOUVER ASSEMBLY WITH TRANSLUCENT LOUVER BAFFLES

(75) Inventor: Eric A. Fishman, Boston, MA (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/907,156

(22) Filed: Jul. 17, 2001

(51) Int. Cl.[7] ..... F21V 11/00

(52) U.S. Cl. ..... 362/291; 362/224; 362/260; 362/354

(58) Field of Search ..... 362/279, 290, 362/291, 292, 307, 342, 354, 260, 223, 224

(56) References Cited

U.S. PATENT DOCUMENTS

| | | | | |
|---|---|---|---|---|
| 2,579,015 A | | 12/1951 | Schoenbrod | |
| 2,607,455 A | | 8/1952 | Yellin | |
| 2,913,576 A | | 11/1959 | Gilleard | |
| 2,960,604 A | | 11/1960 | Guth, Sr. | |
| 3,152,277 A | | 10/1964 | Cutler et al. | |
| 3,169,710 A | | 2/1965 | Lipscomb | |
| 3,996,458 A | * | 12/1976 | Jones et al. | 362/290 |
| 4,418,378 A | | 11/1983 | Johnson | |
| 4,630,181 A | | 12/1986 | Fain et al. | |
| 5,526,244 A | | 6/1996 | Bishop | |
| 5,685,633 A | | 11/1997 | Engel | |
| 5,806,972 A | | 9/1998 | Kaiser et al. | |

* cited by examiner

*Primary Examiner*—Stephen Husar
(74) *Attorney, Agent, or Firm*—John F. Salazar; Middleton Reutlinger

(57) ABSTRACT

A translucent louver assembly is provided with one or more translucent louver baffles and a plurality of opaque baffles. The baffles are mounted in a lighting fixture housing such that the assembly defines a plurality of discrete light-directing cells. The translucent louver baffle provides uniform brightness and color to the cells of the light fixture, including when two or more light fixtures are joined end to end, as typically found in large stores, warehouses, and the like.

14 Claims, 1 Drawing Sheet

LOUVER ASSEMBLY WITH TRANSLUCENT LOUVER BAFFLES

BACKGROUND OF THE INVENTION

1. Technical Field

This invention relates to lighting fixtures and particularly to the use of translucent louver baffles in lighting fixtures.

2. Description of Relevant Art

Using standard opaque louver baffles mounted directly underneath light sources in light fixtures is known. Such louvers are used to direct light upon a desired area of illumination while at the same time restricting light from illuminating other areas.

Flourescent light fixtures are typically provided with rows of louver baffles affixed to at least one longitudinal stringer and set parallel to one another along a length of the fixture and spanning a width of the fixture. The parallel louver baffles and longitudinal stringer(s) create multiple cells which direct light as desired. Such fixtures are typically long and narrow, being substantially rectangular or square in general appearance when installed in a ceiling and viewed from below. A problem facing the lighting industry is that less light emanates from typical flourescent light fixture ends and corresponding cells due to the physical location of opaque louver baffles, support hardware, wiring, and bulb mounting means. This problem is enhanced due to the fact that fluorescent lamps typically emit less light at the ends than nearer the center of the lamp. As a result, undesirable dark areas are found on both ends of the fixtures, and especially between an area from a fixture end to the cells and associated opaque louver baffles mounted closest to each fixture end. This problem becomes more apparent when a plurality of fixtures is mounted end-to-end across a ceiling of a large open room, such as a large department store. Such dark areas can result in reduced customer acceptance of the overall aesthetic appearance of the fixture. Thus, there is a need for a light fixture louver assembly which includes translucent louver baffles that eliminate dark areas at fixture ends, achieves uniform cell brightness and color, is simple to manufacture, costs less to produce, and is easy to use.

SUMMARY OF THE INVENTION

It is an object of the present invention to eliminate dark areas at fixture ends of lighting fixtures.

It is another object of the present invention to provide light fixtures having cells of a uniform brightness and color.

It is even another object of the present invention to provide a light fixture louver assembly having translucent louver baffles which eliminate dark areas at fixture ends.

It is a further object of the present invention to provide a light fixture louver assembly having translucent louver baffles which provide uniform cell brightness and color.

It is even a further object of the present invention to provide a translucent louver baffle of preselected translucent materials for use in a flourescent lighting fixture louver assembly.

It is yet a further object of the present invention to provide a translucent louver baffle of preselected materials for use in a long and narrow flourescent lighting fixture louver assembly.

More particularly, this invention relates to a flourescent light fixture louver assembly having a plurality of opaque louver baffles and at least one translucent louver baffle mounted at at least one preselected location of the louver assembly in a flourescent light housing; the preselected location of said at least one translucent louver baffle being chosen to eliminate dark areas at fixture ends, and to provide uniform cell brightness and color. The preferred translucent louver baffle of the present invention is identical in shape and size to opaque louver baffles used in the same fixture, and is generally manufactured of plastic, glass or other materials of varying translucent characteristics in order to achieve a preselected and desired uniformity of cell brightness and color.

All of the above outlined objectives are to be understood as exemplary only and many more objectives of the invention may be gleaned from the disclosure herein. Therefore, no limiting interpretation of the objectives noted are to be understood without further reading of the entire specification and drawings included herewith.

BRIEF DESCRIPTION OF THE DRAWINGS

A better understanding of the invention will be had upon reference to the following description in conjunction with the accompanying drawings in which like numerals refer to like parts throughout the several views and wherein.

DETAILED DESCRIPTION OF THE PREFERRED EMBODIMENT

Figure 1:
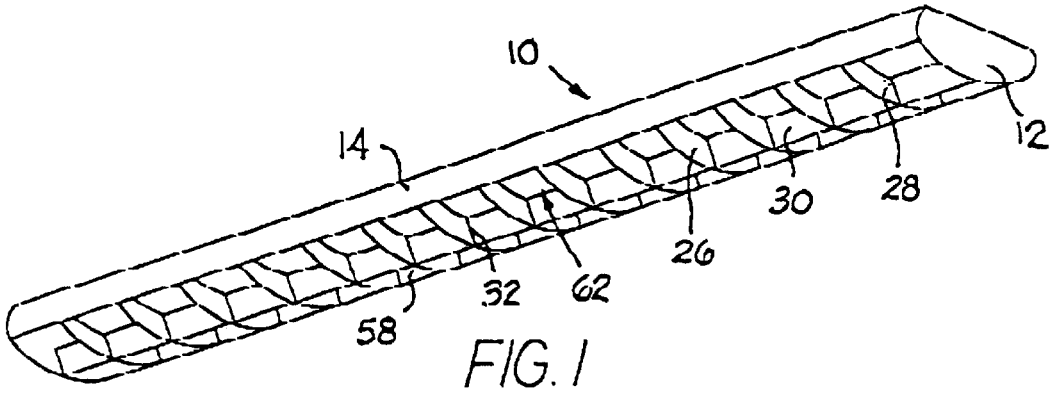
FIG. 1 is a bottom perspective view of a louver assembly of the present invention mounted in a flourescent light fixture.
Figure 2:
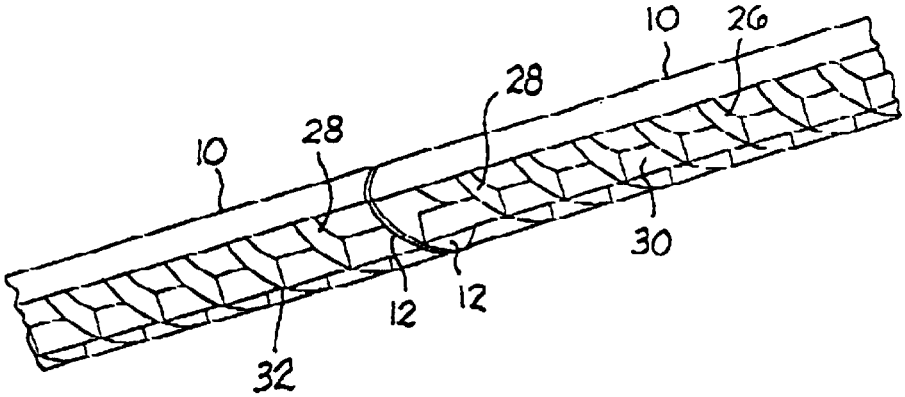
FIG. 2 is a bottom perspective view of louver assemblies of the present invention mounted in adjoining continuous row arranged flourescent light fixture housings; and, FIG. 3 is a side view of a translucent louver baffle of one preferred embodiment of the present invention.

As shown in FIG. 1, a flourescent light fixture 10 includes fixture ends 12 affixed to sides 14 which form a bare fixture housing. First and second side members 14 are interconnected at their distal ends by end members 12 forming an enclosed area therebetween within which the light fixture assembly elements are placed. Further, as shown in FIG. 2, a preferred fixture 10 is modular in that, as desired, two or more fixtures 10 are mechanically joined together end to end by use of a coupler (not shown) mounted between fixture ends 12. Such construction is typical for lighting of long interior areas and increases the visibility of the dark cell issue, discussed above, particularly at the cells adjacent to the end members 12.

Figure 3:
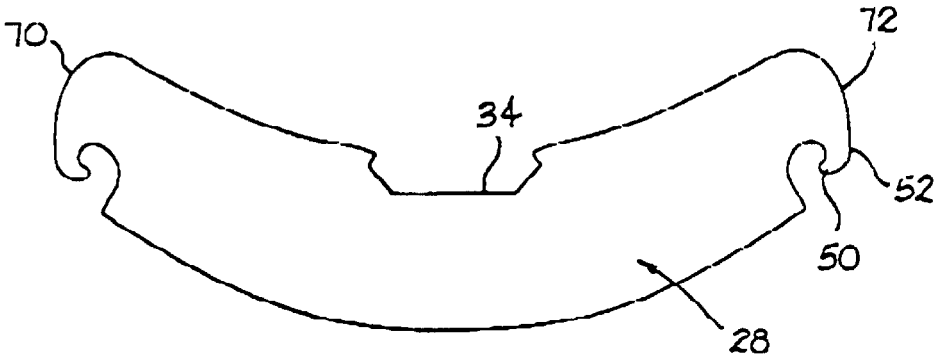

In known fixtures 10, a plurality of opaque louver baffles 26 are typically provided in order to direct light emanating from the fixture 10. Additionally, the present invention provides at least one translucent louver baffle 28 in order to direct light emanating from the fixture 10. Baffles 26 and 28 are formed in an identical geometric shape and size as is shown in a specific embodiment in FIG. 3 and are thus interchangeable when affixed to a central reflector 30. Preferred baffles are generally kidney-shaped; however, square, rectangular, semi-circular, and any other desired baffle shape may be provided as needed. Baffles 26 and 28 are affixed to the central reflector 30 by an interference fit with slits 32 in the central reflector formed perpendicular to a long axis of the reflector 30, the baffles extending through the reflector 30. As desired, baffles 26 and 28 are permanently bonded to the central reflector 30 by use of adhesives, induction sealing, or other bonding methods. An upper central portion 34 of each baffle 26 and 28 abuts a terminating point 36 of each slit or opening 32. Each baffle has a first end 70 and a second end 72.

Baffles 26 and 28 are affixed to central reflector 30 and non-permanently affixed to the remainder of the fixture 10 by positioning members. The positioning members in the present embodiment are formed as notches 50. However, any other configuration that allows non-permanent affixation to the fixture 10 may be utilized. The notches 50 are formed along an outer lower edge 52 and at each end 70 and 72 of each baffle 26 and 28. The notches 50 are aligned with a receiving surface (not shown) formed along an inside lower edge of each side 14. Fixation of baffles 26 and 28 to central reflector 30 and the remainder of the fixture 10 defines a plurality of discrete light-directing cells 62.

Translucent louver baffles 28 are used in order to eliminate dark areas at fixture 10 ends 12 and to achieve a desired uniformity of cell 62 brightness and color. In the lighting industry, cells 62 are regions between louver baffles 26 and 28, and reflector 30 and side reflector 58. Side reflector 58 may be provided in each lateral side wall 14 of the fixture 10 in order to more properly reflect light into each individual cell. Such cells 62 are formed in order to direct light onto a preselected area of an intended illuminated surface in proximity to a fixture 10. Using preselected dimensions of louver baffles 26 and 28, and reflectors 30 and 58, and preselected placement in relation to bulbs (not shown), each cell 62 directs light at preselected angles from the fixture 10.

The problem of maintaining uniform cell 62 brightness and color when two or more fixtures 10 are mounted abutting one another is readily solved by the use of translucent louver baffles 28 of the present invention at selected locations within flourescent lighting fixture 10. Thus, problematic dark cells, typically located at the ends of the light fixture, may be eliminated by use of a translucent baffle 28 at the end of the light fixture. Thus, more light is allowed to fill the cells in the distal end cell nearest the first and second end members 12 of the light fixture. Further, careful selection of translucent baffles in combination with opaque baffles gives the appearance that the translucent baffle is opaque, with a color and brightness uniform to opaque baffles.

Another preferred embodiment of the present invention is to provide and substitute as desired for a preselected number of known opaque louver baffles 26 in fixtures 10, translucent louver baffles 28 of an identical shape and size, and thereby adapt such fixtures 10 to thereafter feature the benefits and advantages inherent in the use of translucent louver baffles 28. It is clear to see that after such substitution, other current fixtures 10 are modified and improved, now being able to eliminate dark areas at fixture 10 ends and to achieve a desired uniformity of cell 62 brightness and color.

In any use of translucent louver baffles 28, materials such as plastic or glass are used in order to achieve a preselected amount of translucence in achieving a desired uniformity of cell brightness and color. Practical testing with finished fixtures 10 and a variety of available translucent louver baffles 28 of varying translucence readily provides those skilled in the art of lighting fixtures 10 with selecting the desired amount of translucence and color needed for various lighting situations.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A fluorescent lighting fixture, comprising:

a first and second side member having first and second interconnecting end members;

a central reflector extending from said first end member to said second end members and between said first and second side member;

a plurality of baffles extending from said first side member to said second side member;

wherein said plurality of baffles are a first plurality of opaque baffles and a second plurality of translucent baffles.

2. The lighting fixture of claim 1 wherein said plurality of translucent baffles are a first and a second baffle, said first baffle near said first end member of said fixture and said second baffle near said second end member of said fixture.

3. The lighting fixture of claim 2 wherein each of said plurality of baffles extend through said central reflector.

4. The lighting fixture of claim 3 wherein said central reflector has a plurality of openings through which said baffles extend.

5. The lighting fixture of claim 3 wherein said plurality of baffles are removably affixed to said first and second side member.

6. The lighting fixture of claim 5 wherein each of said plurality of baffles is further comprised of a first and a second end, each of said first and second end having a notch formed therein.

7. The lighting fixture of claim 6 wherein said first and said second side member receive said notch formed on said first and second end of each of said plurality of baffles.

8. A fluorescent lighting fixture, comprising:

a first and second side member having first and second interconnecting end members;

a central reflector extending from said first end member to said second end members and between said first and second side member;

a plurality of baffles extending from said first side member to said second side member;

wherein said plurality of baffles are a first plurality of opaque baffles and a second plurality of translucent baffles, said plurality of translucent baffles being a first and a second baffle, said first baffle near said first end member of said fixture and said second baffle near said second end member of said fixture.

9. A fluorescent lighting fixture, comprising:

a housing retaining at least one fluorescent lamp, said housing having a first and second side member and a first and a second interconnecting end member;

a plurality of baffles retained within said housing;

wherein said plurality of baffles are a first plurality of opaque baffles and a second plurality of translucent baffles; and wherein said plurality of translucent baffles are a first and a second baffle, said first baffle near said first end member of said fixture and said second baffle near said second end of said fixture.

10. The lighting fixture of claim 9 wherein each of said plurality of baffles extend through a central reflector extending from said first end member to said second end member.

11. A louver assembly for use in a light fixture, comprising:

a plurality of opaque louver baffles and at least one translucent louver baffle of identical shape and size as said opaque louver baffles;

said opaque and translucent baffles arranged so as to define lighting-directing cells in close proximity to a tubular flourescent lamp;

wherein said at least one translucent baffle is arranged on said louver assembly near a darker end of said tubular flourescent lamp so that light passes through said translucent baffles to create the appearance of equivalent illumination in all cells; and wherein the arrangement on said louver assembly and composition of said translucent baffles is selected so as to create the appearance of opacity and reflectivity of said translucent louver baffles equivalent to said opaque louver baffles.

12. The louver assembly of claim 11 wherein said translucent louver baffle is of unitary construction.

13. The louver assembly of claim 12 wherein said translucent louver baffle has an upper central portion and a notch to receive a slit terminating edge of a central reflector of said light fixture.

14. The louver assembly of claim 13 wherein said translucent louver baffle has first and second ends, each having a positioning member for removable affixation to a receiving surface of said light fixture.

* * * * *